US005983777A

United States Patent [19]

Cassaday

[11] Patent Number: 5,983,777

[45] Date of Patent: Nov. 16, 1999

[54] METHOD AND APPARATUS FOR DIAPHRAGM PUMPING WITH ADJUSTABLE FLOW

[76] Inventor: Michael M. Cassaday, Four Todd La., Somers, N.Y. 10589

[21] Appl. No.: 08/992,986

[22] Filed: Dec. 18, 1997

[51] Int. Cl.[6] ..... F01B 19/00; F16J 3/00

[52] U.S. Cl. ..... 92/13.2; 92/97

[58] Field of Search ..... 92/13.2, 13.1, 92/97

[56] References Cited

U.S. PATENT DOCUMENTS

| | | | |
|---|---|---|---|
| 2,827,853 | 3/1958 | Bradley | 417/383 |
| 2,856,857 | 10/1958 | Salfrank . | |
| 2,881,596 | 4/1959 | Sheen | 92/97 |
| 3,605,566 | 9/1971 | Vetter | 92/97 |
| 3,769,879 | 11/1973 | Loftquist . | |

OTHER PUBLICATIONS

"Milton Roy Meter Pump Technology" Bulletin 210, pp. 7 and 8.

"Milton Roy Meter Pump Technology" Bulletin 3600, excerpt.

"Milton Roy Meter Pump Technology" DRDS PD 4151.

*Primary Examiner*—John E. Ryznic
*Attorney, Agent, or Firm*—Ference & Associates

[57] ABSTRACT

An improved method and apparatus for adjusting the flow of a diaphragm pump. The thickness of the diaphragm itself is capable of being adjusted. Full stroke output is thereby reduced in inverse proportion to the increased volume occupied by the diaphragm. Adjusting the thickness of the diaphragm while the pump is operating provides a means of varying pump output without stopping the pump for adjustments or modifications.

17 Claims, 4 Drawing Sheets

METHOD AND APPARATUS FOR DIAPHRAGM PUMPING WITH ADJUSTABLE FLOW

This application relates to a method and apparatus for adjusting the flow of process fluid in a diaphragm liquid end of a positive displacement pump.

BACKGROUND OF THE INVENTION

There are two major divisions into which pumps may be classified; Non-positive displacement and Positive displacement.

Non-positive displacement pumps induce flow by means of a device such as a propeller or centrifugal impeller. Such pumps are well suited for bulk transport but their flow output is difficult to predict as the flow output of non-positive displacement pumps is substantially dependent on fluid and system parameters such as discharge pressure and viscosity.

Positive displacement pumps move fluids by means of a displacement element sealed to retard or altogether prevent fluid leakage. A motive force applied to the displacement element regulates the flow rate. There are several types of such displacement elements or liquid ends, including piston, disc diaphragm, and tubular diaphragm. The liquid output of a positive displacement pump is accurate and predictable over a wide range of conditions, being governed only by the stroke rate and displacement volume of the piston.

The simplest such type is a piston sealed within a cylinder by a packing or sealing ring. Liquid, an incompressible fluid, contained between the housing and piston will discharge from the pump at a rate governed by the rate of the motive force resulting from advancement of the piston into the cylinder. Fluid is delivered at this rate in a manner essentially independent of fluid or discharge conditions.

"Milton Roy Meter Pump Technology," Bulletin 210, page 7 and 8 discloses a variety of disc diaphragm liquid ends, which builds upon the piston pump previously described. These disc diaphragm liquid ends have a diaphragm which acts as a barrier between the piston and the process fluid. The piston's pumping motion is applied to hydraulic fluid which communicates the piston action to the diaphragm and causes the diaphragm to flex back and forth as the piston reciprocates. The diaphragm, in turn acts upon the process fluid.

Typically a disc diaphragm liquid end uses discharge and suction contour plates to restrain the maximum suction and discharge position of the disk diaphragm. The volume contained between the contour plates minus the volume occupied by the diaphragm is generally set to be slightly greater than the volume displaced by the piston at full stroke. The diaphragm thereby oscillates between the confines of the contour plates without contacting said contour plates during normal pump operation. Slight piston leakage over time or other physical changes such as temperature induced expansion of working fluid or starved suction operation may cause the diaphragm to contact the suction or discharge contour plates.

Contact with the discharge contour plate, prior to completion of the piston discharge stroke, causes a pressure increase in the working fluid. The pressure increase is a result of the constraint on the discharge motion by the contour plate while the piston continues to force the diaphragm in the discharge direction. This pressure increase causes a relief valve to open, effectively bypassing the piston working fluid back to the supply reservoir. In a similar manner, contact with the suction contour plate prior to completion of a suction stroke causes a decrease in working fluid pressure opening the vacuum breaker relief valve. Contour plates serve to both describe the maximum allowable volume delivered per stroke and to keep the diaphragm synchronized with the piston.

It is possible to replace the piston and working fluid with an external source of air pressure and vacuum and a suitable valving arrangement. Here air pressure is directed to the diaphragm to effect a discharge stroke. The valve is switched to vent the air pressure and direct a vacuum to the diaphragm initiating a suction stroke. Here the delivered volume is equal to the volume captured between the contour plates minus the thickness of the diaphragm so long as the valve is maintained in pressure or vacuum for sufficient time to assure full contact with each respective plate.

"Milton Roy Metering Pump Technology," Bulletin 210, page 7 discloses a tubular diaphragm liquid end, which places two different flexible, sealed members between the piston and the process fluid. In this liquid end, the piston forces hydraulic fluid to flex a disc diaphragm. The disc diaphragm then transfers the pumping action to an intermediate fluid which surrounds an elastomeric tubular diaphragm, through which the process fluid passes. A tubular diaphragm liquid end has been primarily used for pumping slurries and viscous applications.

These types of positive displacement pumps use a piston, and the more advanced liquid ends also use some sort of diaphragm. The flow rates for such positive displacement pumps are generally adjusted by modulating the stroking rate and the stroke length of the piston. Two patents which disclose methods used to adjust the stroke length of a displacement element are U.S. Pat. No. 2,856,857 to Salfrank and U.S. Pat. No. 3,769,879 to Loftquist. A variable speed motor is a common method of adjusting stroking rate. In a diaphragm type liquid end, the stroke length has also been modified by bypassing the working fluid for a portion of the piston stroke to remove motive force from the diaphragm. Bypassing is an effective and inexpensive stroke adjustment means but imposes shock on the mechanism and process fluid plumbing. These mechanical stroke adjustments tend to be complex, expensive and difficult to economically miniaturize.

SUMMARY OF THE INVENTION

The present invention includes a method and apparatus for adjusting volume discharged per stroke and thereby the flow of the process fluid in those positive displacement pumps which use a sealed flexible member in the liquid end. The present invention uses a double walled diaphragm, which is capable of different thicknesses, to change the volume of the process fluid discharged per stroke without changing the stroke rate or stroke length of the piston. Alternatively, the invention may be used to adjust the volume delivered per stroke for other sources and types of working fluid such as, but not limited to an air pressure, vacuum combination. Alternatively, the invention includes the apparatus necessary to affect a change in the thickness of the multi-walled diaphragm.

DETAILED DESCRIPTION OF THE INVENTION

Figure 1A:
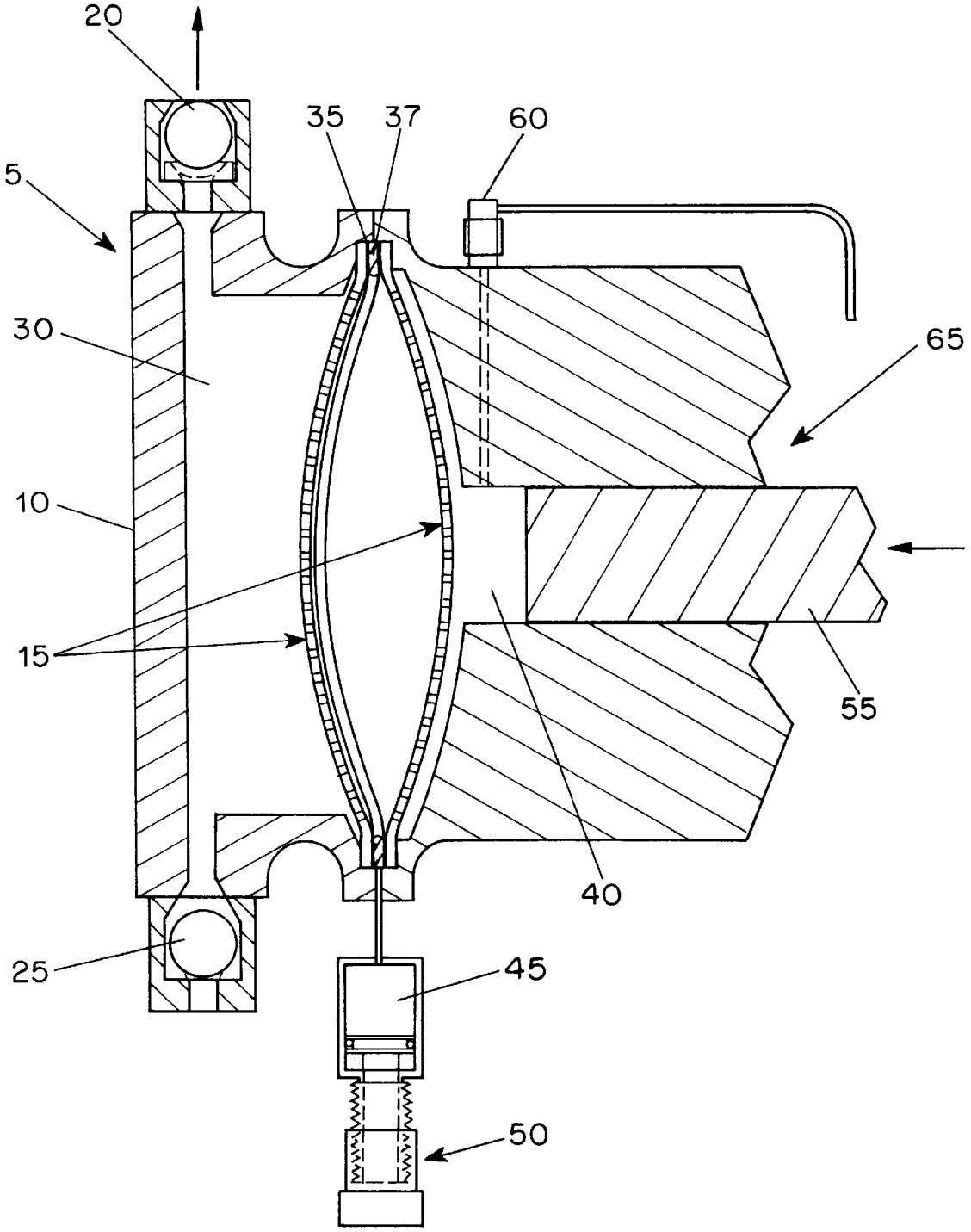
FIG. 1*a* shows the operation of multi-walled diaphragm during a full volume discharge stroke.
Figure 1B:
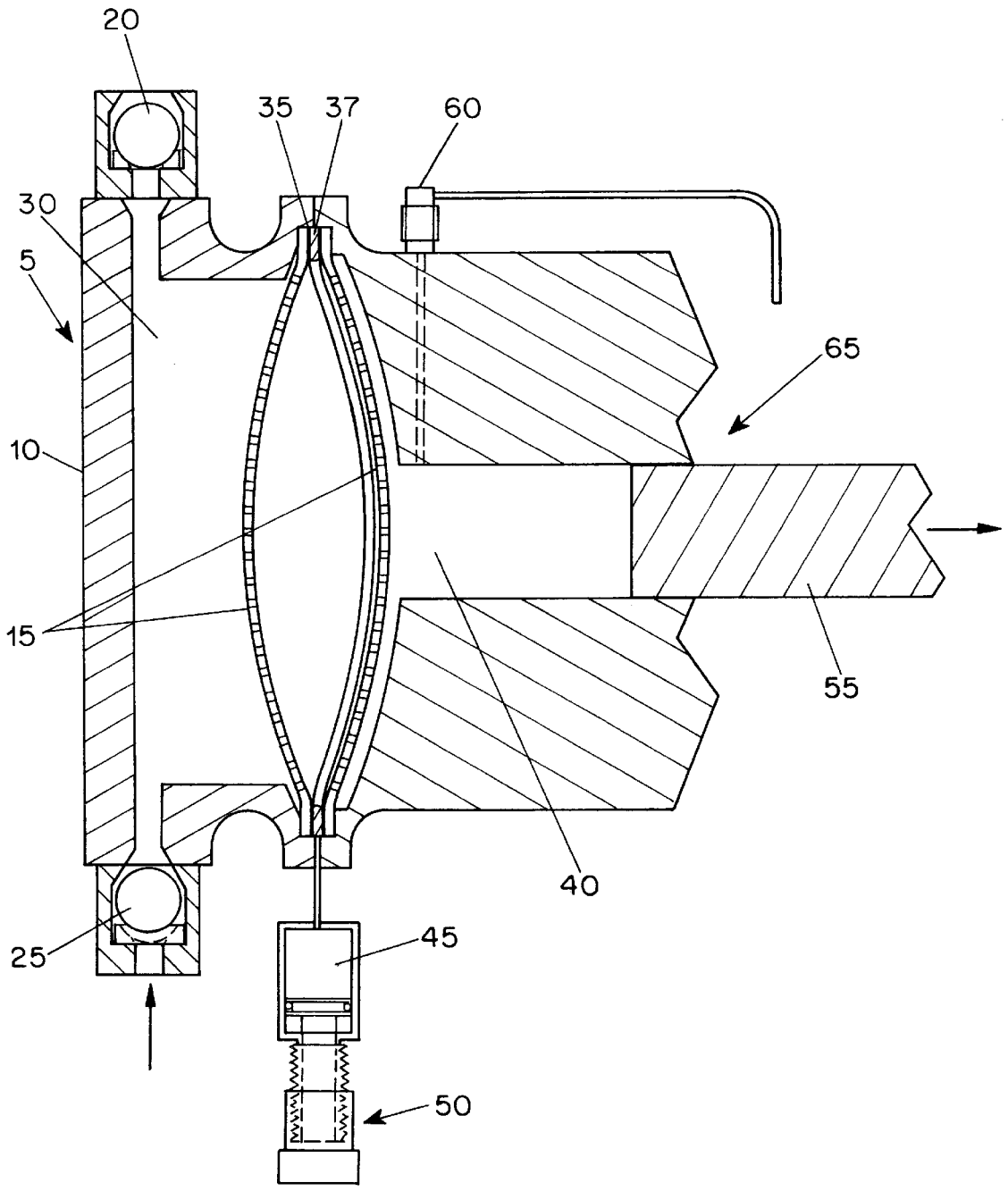
FIG. 1*b* shows the operation of multi-walled diaphragm during a full volume suction stroke.

Referring to FIGS. 1*a* and 1*b,* a disc diaphragm liquid end of a positive displacement pump is shown generally at 5 and includes housing 10, contour plates 15, discharge check valve 20, suction check valve 25, process fluid displacement chamber 30, diaphragm 35, ring 37, working fluid 40, adjuster oil 45, adjustment micrometer 50, piston 55, overpressure valve 60, and bypass flow 65. FIG. 1*a* shows diaphragm 35 in position of a full volume discharge, and FIG. 1*b* shows diaphragm 35 in position of a full volume suction stroke.

Diaphragm 35 may consist of two conventional diaphragms or flexible members sandwiched between contour plates 15. The diaphragms are sealed around the outer edge by a ring 37 situated about the outer rim of the diaphragms. The ring 37, contour plates 15 and diaphragms are held together in a leak tight manner by the clamping forces used to seal the displacement chamber. The outer ring is in fluid communication with an external adjustment device 50 consisting of a chamber with a sealed movable component such as a piston and associated micrometer scale for setting reference. The volume between the diaphragms and communicating on through to the adjustment piston is completely filled with adjuster oil 45, an incompressible low vapor pressure fluid such as, but not limited to, silicone oil or vacuum pump oil. Moving the adjustment piston in displaces oil into the cavity between the two diaphragms effectively increasing the thickness of the twin diaphragm and reducing the volume discharged per stroke. Moving the adjustment 50 out allows the twin diaphragms to move closer together increasing volume per stroke.

Figure 2A:
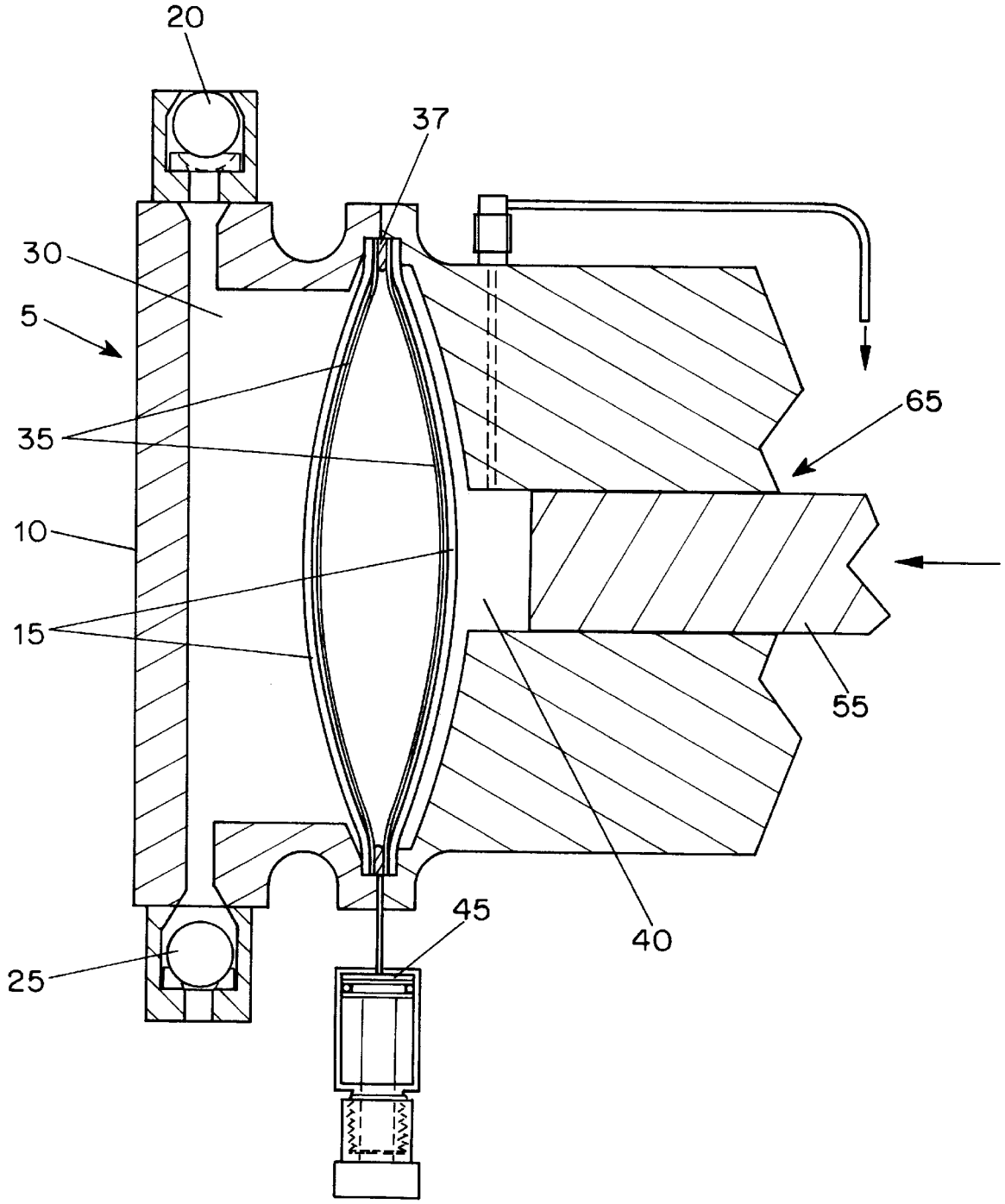
FIG. 2*a* shows the operation of multi-walled diaphragm during a low volume discharge stroke.
Figure 2B:
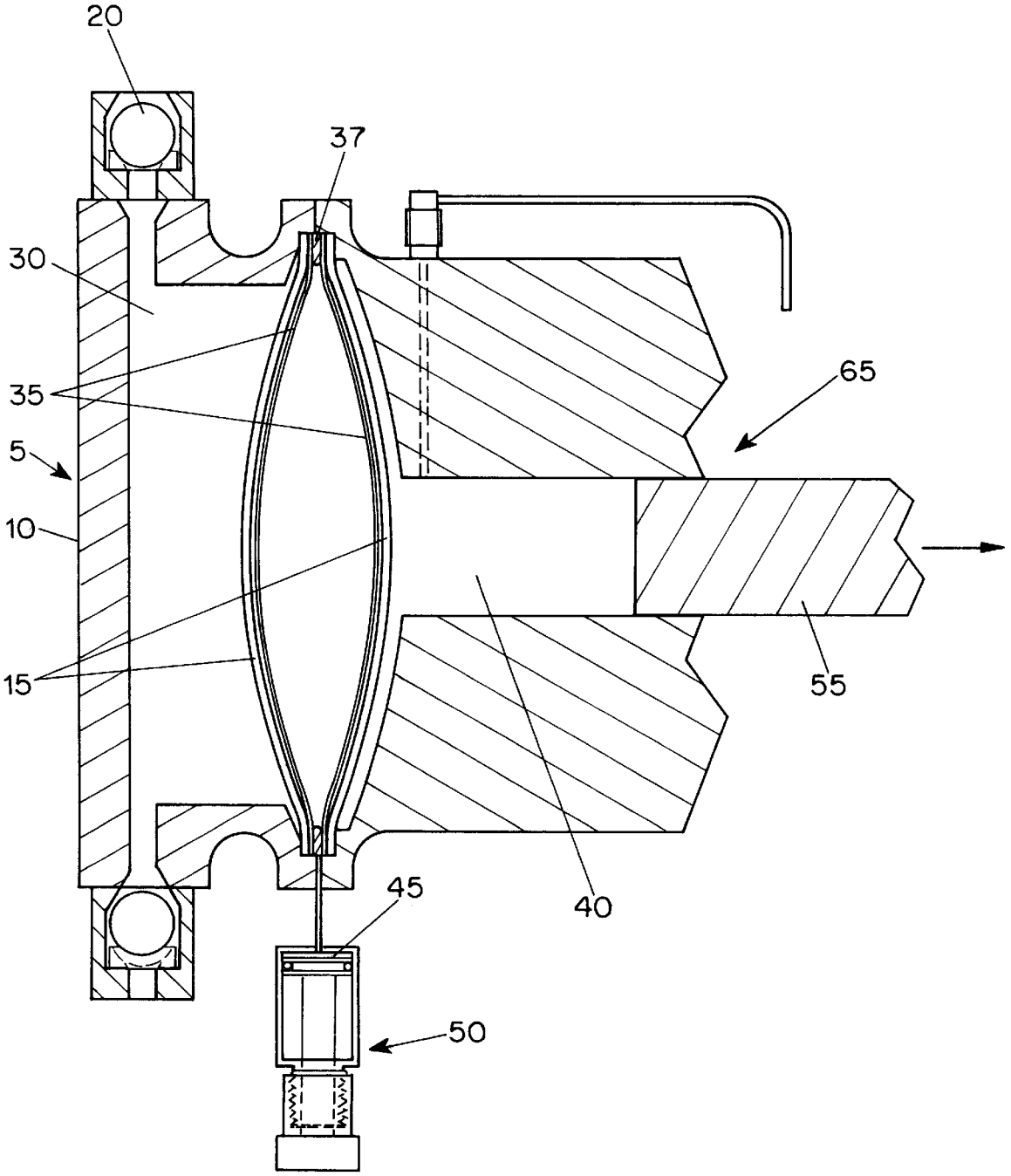
FIG. 2*b* shows the operation of multi-walled diaphragm during a low volume suction stroke.

Referring to FIGS. 2*a* and 2*b,* similar reference numbers are used to indicate like items, and adjustment micrometer 50 has been adjusted to insert adjuster oil 45 into diaphragm 35. FIG. 2*a* shows diaphragm 35 in position of a low volume discharge, while FIG. 2*b* shows diaphragm 35 in position of a low volume suction stroke.

As the figures show, the volume displaced by a diaphragm pump on full stroke setting is equal to the volume contained between the contour plates 15 minus the volume occupied by the diaphragm 35. Replacing diaphragm 35 with a thicker material will reduce full stroke output in inverse proportion to the increased volume occupied by the new diaphragm. By adjusting the thickness of diaphragm 35 while the pump is operating provides a means of varying pump output without stopping the pump for adjustments or modifications.

The invention embodies all of the benefits of a fluid actuated diaphragm pump and allows on line flow adjustment with a simple, robust means. The mechanism is further suitable for miniaturization where low cost, molded, adjustable diaphragm pumps could be easily manufactured to deliver fractions of a milliliter volumes precisely and accurately.

This type of volume adjustment is ideal for a small, inexpensive pneumatically actuated pump. The invention can be used as a one time setting where the adjustable piston is replaced by a sealed set screw. Once the discharge volume is accurately set by adjusting twin diaphragm spacing with the set screw, the screw is sealed. This is a rapid and inexpensive method of fine tuning pump volumes in the factory.

While there have been described what are believed to be the preferred embodiments of the invention, those skilled in the art will recognize that other and further modifications may be made thereto without departing from the invention and it is intended to claim all such changes and modifications as fully within the scope of the invention.

I claim:

1. A liquid end of a positive displacement pump, comprising:

a housing with process fluid intake opening and a discharge opening;

a process fluid displacement chamber disposed within said housing;

means for regulating the flow of a process fluid into said intake opening, through said process fluid displacement chamber and out said discharge opening in response to a motive force; and means for adjusting said flow independently of the operation of said motive force;

said adjusting means comprising first and second flexible members that define therebetween an adjustable volume for governing at least one parameter of said flow, said volume being open and unimpeded substantially at all times.

2. The liquid end of a displacement pump of claim 1, wherein said means for adjusting said flow independent of the operation of said motive force comprises:

first and second contour plates joined together and disposed within said process fluid displacement chamber;

first and second flexible members, each having an outer rim, placed between said first and second contour plates and said flexible members sealed to each other by a ring situated about said outer rim, thereby defining a volume; and means for adjusting said volume.

3. The liquid end of a displacement pump of claim 2, wherein said means for adjusting said volume comprises:

a sealed movable piston and a micrometer scale operatively connected to said flexible members for adjusting said volume by controlling the amount of an incompressible, low vapor pressure fluid contained between said flexible members.

4. The liquid end of a displacement pump of claim 3, wherein said low vapor pressure fluid is silicone oil or vacuum pump oil.

5. In a positive displacement pump, of the type using a diaphragm, the improvement comprising using a diaphragm capable of having its thickness varied;

said diaphragm comprising first and second flexible members that define therebetween an adjustable volume for governing at least one parameter of flow in said pump, said volume being open and unimpeded substantially at all times.

6. A method for adjusting the flow of the liquid end of a positive displacement pump, of the type using a diaphragm, said diaphragm comprising first and second flexible members, said method comprising:

determining the flow of the process fluid based upon the stroke displacement of a piston used to induce flow of the process fluid;

adjusting the flow of the process fluid by adjusting the effective volume of the diaphragm, said volume being defined between the first and second flexible members and being adapted to govern at least one parameter of said flow, said volume being open and unimpeded substantially at all times.

7. A method for adjusting the thickness of a diaphragm in a positive displacement pump, said diaphragm comprising first and second flexible members, said method comprising the steps of:

adjusting the amount of an incompressible fluid contained within said diaphragm said amount being defined in a volume between said first and second flexible members, said volume being adapted for governing at least one parameter of flow in said pump, said volume being open and unimpeded substantially at all times;

ensuring that the amount of incompressible fluid contained within said diaphragm does not change until a further adjustment is desired.

8. The liquid end of a displacement pump of claim 1, wherein, said motive force is provided by an incompressible fluid, said incompressible fluid being driven by an external reciprocating piston;

said incompressible fluid provided by a valve operating to alternately select between a pressure source and vacuum source.

9. The liquid end of a displacement pump of claim 1, wherein, said motive force is provided by a compressible fluid, said compressible fluid being driven by an external reciprocating piston;

said compressible fluid provided by a valve operating to alternately select between a pressure source and vacuum source.

10. The liquid end of a positive displacement pump of claim 1, comprising a single common inlet and outlet connection port wherein:

the selection between fluid to be aspirated and fluid to be discharged is accomplished by an external valve communicating with said common connection port;

the selection between fluid to be aspirated and fluid to be discharged is accomplished by means of moving a pipe portion communicating with said common connection port into fluid to be aspirated during the suction stroke and subsequently on to a receiving portion intended to accept discharge fluid.

11. The liquid end of a displacement pump of claim 1, wherein said at least one parameter includes the volume discharged per stroke of a process fluid of said pump.

12. The liquid end of a displacement pump of claim 1, wherein said volume is substantially fully collapsible between said first and second flexible members.

13. The liquid end of a displacement pump of claim 1, wherein said volume is fully collapsible between said first and second flexible members but for at least one peripheral impediment between said first and second flexible members.

14. The liquid end of a displacement pump according to claim 13, wherein said at least one peripheral impediment comprises a ring interposed between said first and second flexible members at the periphery of said first and second flexible members.

15. A liquid end of a positive displacement pump, comprising:

a housing with process fluid intake opening and a discharge opening;

a process fluid displacement chamber disposed within said housing;

means for regulating the flow of a process fluid into said intake opening, through said process fluid displacement chamber and out said discharge opening in response to a motive force; and means for adjusting said flow independently of the operation of said motive force;

said adjusting means comprising:

first and second contour plates joined together and disposed within said process fluid displacement chamber;

first and second flexible members, each having an outer rim, placed between said first and second contour plates and said flexible members sealed to each other by a ring situated about said outer rim, thereby defining a volume; and means for adjusting said volume.

16. The liquid end of a displacement pump of claim 15, wherein said means for adjusting said volume comprises:

a sealed movable piston and a micrometer scale operatively connected to said flexible members for adjusting said volume by controlling the amount of an incompressible, low vapor pressure fluid contained between said flexible members.

17. The liquid end of a displacement pump of claim 16, wherein said low vapor pressure fluid is silicone oil or vacuum pump oil.

* * * * *